US009790759B2

(12) United States Patent
Nguyen

(10) Patent No.: US 9,790,759 B2
(45) Date of Patent: Oct. 17, 2017

(54) MULTI-COMPONENT TUBULAR COUPLING FOR WELLHEAD SYSTEMS

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 381 days.

(21) Appl. No.: 14/552,418

(22) Filed: Nov. 24, 2014

(65) Prior Publication Data

US 2015/0075771 A1 Mar. 19, 2015

Related U.S. Application Data

(63) Continuation of application No. 13/144,446, filed as application No. PCT/US2010/027211 on Mar. 12, 2010, now Pat. No. 8,893,774.

(60) Provisional application No. 61/165,481, filed on Mar. 31, 2009.

(51) Int. Cl.

| | |
|---|---|
| ***E21B 33/038*** | (2006.01) |
| ***E21B 33/04*** | (2006.01) |
| ***E21B 33/047*** | (2006.01) |
| ***E21B 33/068*** | (2006.01) |

(52) U.S. Cl.

CPC ..... *E21B 33/038* (2013.01); *E21B 33/04* (2013.01); *E21B 33/047* (2013.01); *E21B 33/0422* (2013.01); *E21B 33/068* (2013.01)

(58) Field of Classification Search

None

See application file for complete search history.

(56) References Cited

U.S. PATENT DOCUMENTS

| | | | | |
|---|---|---|---|---|
| 2,122,071 | A | 6/1938 | Rasmussen et al. | |
| 5,066,048 | A | 11/1991 | Farrell | |
| 6,530,433 | B2 | 3/2003 | Smith et al. | |
| 6,554,324 | B1 | 4/2003 | Herman | |
| 6,598,673 | B1 * | 7/2003 | Hosie | E21B 33/04 166/208 |
| 6,920,925 | B2 | 7/2005 | Duhn et al. | |
| 7,032,677 | B2 | 4/2006 | McGuire et al. | |

(Continued)

FOREIGN PATENT DOCUMENTS

| | | |
|---|---|---|
| WO | 2008140856 A1 | 11/2008 |
| WO | 2009094245 A2 | 7/2009 |

OTHER PUBLICATIONS

PCT International Search Report and Written Opinion; Application No. PCT/US2010/027211; Mailed Sep. 28, 2010; 13 pages.

(Continued)

*Primary Examiner* — Caroline Butcher
(74) *Attorney, Agent, or Firm* — Fletcher Yoder, P.C.

(57) ABSTRACT

A multi-component tubular coupling is provided for wellhead assemblies. In one embodiment, the multi-component tubular coupling may include a first tubular member, a landing ring, and a second tubular member. The second tubular member may include internal threads, lock screws, or any combination thereof to couple to a wellhead component. In another embodiment, the multi-component tubular coupling may only include the first tubular member and the landing ring. In such an embodiment, a wellhead component may be secured to the coupling via lock screws.

22 Claims, 10 Drawing Sheets

(56) References Cited

U.S. PATENT DOCUMENTS

| | | | |
|---|---|---|---|
| 7,066,269 | B2 | 6/2006 | Dallas et al. |
| 7,150,323 | B2 | 12/2006 | Ford |
| 7,278,490 | B2 | 10/2007 | McGuire et al. |
| 7,322,407 | B2 | 1/2008 | Duhn et al. |
| 7,604,058 | B2 | 10/2009 | McGuire |

OTHER PUBLICATIONS

Examination Report; Application No. GB1118137.7; Dated Oct. 30, 2012; 5 pages.

* cited by examiner

MULTI-COMPONENT TUBULAR COUPLING FOR WELLHEAD SYSTEMS

CROSS REFERENCE TO RELATED APPLICATIONS

This application claims priority to and benefit of U.S. patent application Ser. No. 13/144,446, entitled "Multi-Component Tubular Coupling for Wellhead Systems," filed Jul. 13, 2011, which is herein incorporated by reference in its entirety, and which claims priority to and benefit of PCT Patent Application No. PCT/US2010/027211, entitled "Multi-Component Tubular Coupling for Wellhead Systems," filed Mar. 12, 2010, which is herein incorporated by reference in its entirety, and which claims priority to and benefit of U.S. Provisional Patent Application No. 61/165,481, entitled "Multi-Component Tubular Coupling for Wellhead Systems", filed on Mar. 31, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations.

Couplings (also referred to as connectors) are employed to attach certain components together and to wellhead housings. Existing connectors often require machining of the components and/or the connector, such as to machine threads or other fastening mechanism into the component and/or connector. Further, existing connectors may be manufactured for each type and diameter of connection, resulting in increased cost and inventory. Additionally operations to attach or remove existing connectors may be generally expensive and time-consuming.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present invention include a multi-component tubular coupling for wellhead components. In one embodiment, the coupling includes a first tubular member, a landing ring, and a second tubular member. In another embodiment, the coupling includes only the first tubular member and the landing ring. The landing ring may engage the first tubular member via a threaded connection. The second tubular member may be disposed over the landing ring and include protrusions extending underneath a flanged portion of the landing ring. The second tubular member may include internal threads configured to couple to a wellhead component, securing the wellhead component to the coupling. In some embodiment, the first tubular member may be a coupling having standardized threads and/or diameters. Other embodiments of the multi-component tubular coupling may include lock screws with or without the internal threads.

Figure 1A:
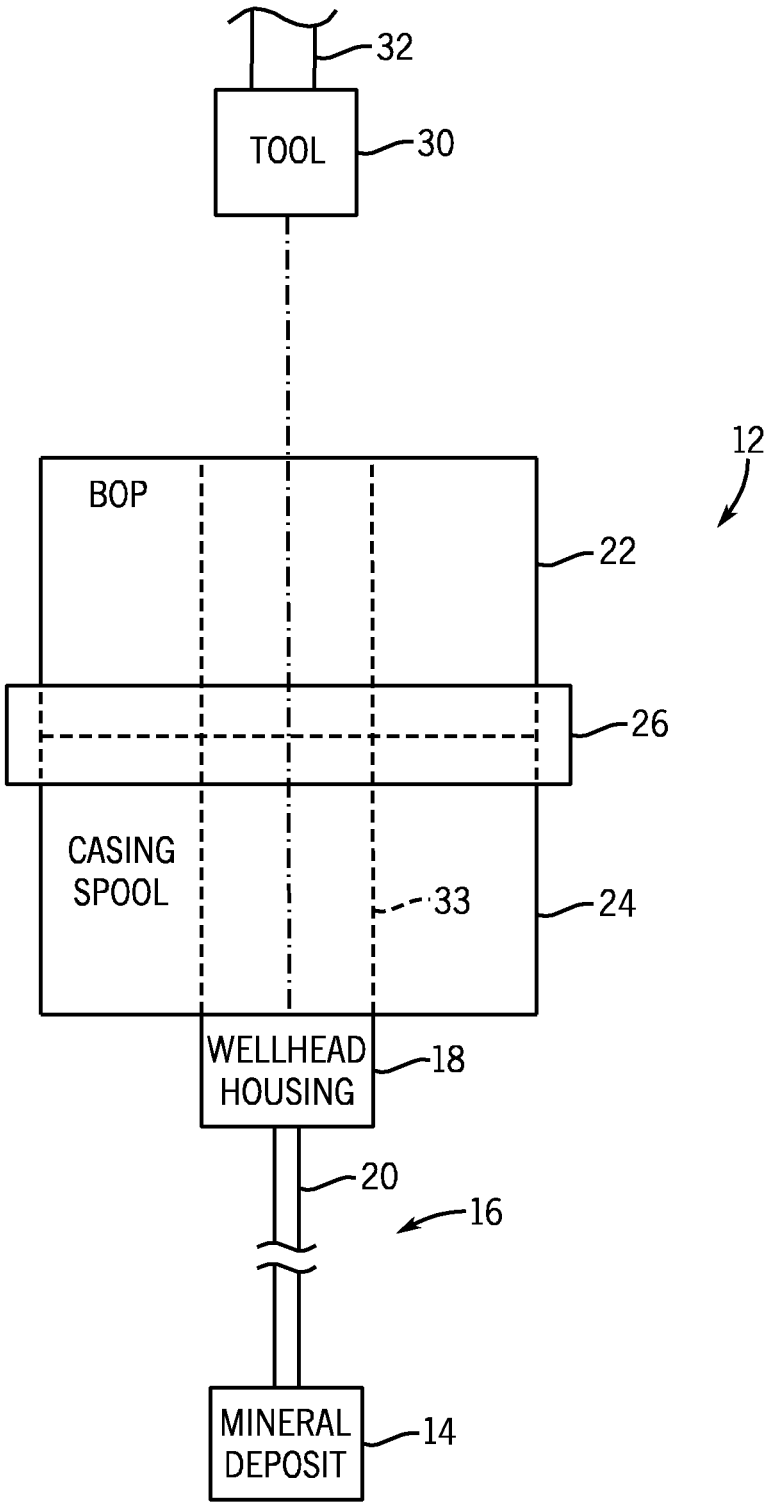
FIGS. 1A and 1B are block diagrams of a mineral extraction system in accordance with an embodiment of the present invention.
Figure 1B:
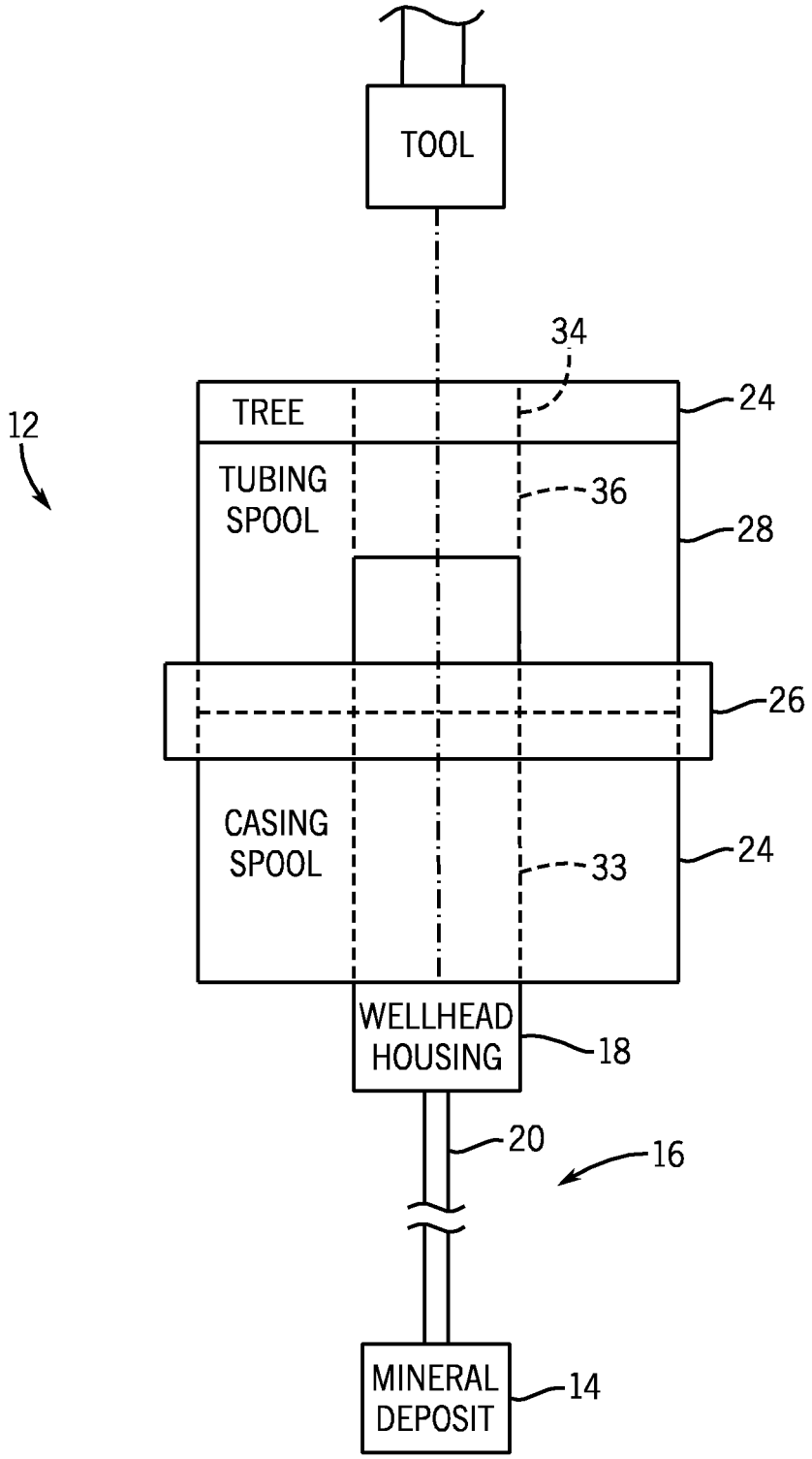

FIGS. 1A and 1B are a block diagrams that illustrates an embodiment of a mineral extraction system 10. As discussed below, one or more tubular couplings are employed throughout the system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead assembly 12 coupled to a mineral deposit 14 via a well 16, wherein the well 16 includes a wellhead hub 18 and a well-bore 20. The wellhead hub 18 generally includes a large diameter hub that is disposed at the termination of the well-bore 20. The wellhead hub 18 provides for the sealable connection of the wellhead assembly 12 to the well 16.

The wellhead assembly 12 typically includes multiple components that control and regulate activities and conditions associated with the well 16. For example, the wellhead assembly 12 generally includes bodies, valves and seals that route produced minerals from the mineral deposit 14, provide for regulating pressure in the well 16, and provide for the injection of chemicals into the well-bore 20 (down-hole). For example, FIG. 1A illustrates a blowout preventer (BOP) stack 22 coupled to a casing spool 24 via a tubular coupling 26, such as during changing of components of the system 10. FIG. 1B depicts another operation of the wellhead assembly illustrating a tubing spool 28 coupled to the casing spool 24 via the tubular coupling 26, such as during installation of a tubing hanger and extraction of the mineral from the well 16.

In the illustrated embodiment, the wellhead assembly 12 may include what is colloquially referred to as a Christmas tree 29 (hereinafter, a tree). The system 10 may include other devices that are coupled to the wellhead assembly 12, and devices that are used to assemble and control various components of the wellhead assembly 12. For example, in FIG. 1A, the system 10 includes a tool 30 suspended from a drill string 32. In certain embodiments, the tool 28 includes a running tool that is lowered (e.g., run) from an offshore vessel to the well 16 and/or the wellhead 12. In other embodiments, such as surface systems, the tool 30 may include a device suspended over and/or lowered into the wellhead 12 via a crane or other supporting device.

The blowout preventer (BOP) stack 22 may also be included during drilling or workover operations. The BOP may consist of a variety of valves, fittings and controls to prevent oil, gas, or other fluid from exiting the well in the event of an unintentional release of pressure or an unanticipated overpressure condition. The BOP 22 may be hydraulically operated and may close the wellhead assembly 12 or seal off various components of the wellhead assembly 12. During operation of the system 10, a BOP 22 may be installed during removal or installation of additional components, changes in operation of the system 10, or for other safety reasons. For example, in one embodiment, installation of the BOP 22 may be performed before installation of the tubing spool 28, such as for moving to production. As described further below, the BOP 22 may be coupled to the casing spool 24 by the multi-component tubular coupling 26. The BOP 22 may be removed from the wellhead assembly 12 and the tubing spool 28 may then be coupled to the casing spool 24 using the tubular coupling 26.

Turning in more detail to FIG. 1 B, the tree 29 generally includes a variety of flow paths (e.g., bores), valves, fittings, and controls for operating the well 16. For instance, the tree 29 may include a frame that is disposed about a tree body, a flow-loop, actuators, and valves. Further, the tree 29 may provide fluid communication with the well 16. For example, the tree 29 includes a tree bore 34. The tree bore 34 provides for completion and workover procedures, such as the insertion of tools (e.g., the hanger) into the well 16, the injection of various chemicals into the well 16 (down-hole), and the like. Further, minerals extracted from the well 16 (e.g., oil and natural gas) may be regulated and routed via the tree 29. For instance, the tree 12 may be coupled to a jumper or a flowline that is tied back to other components, such as a manifold. Accordingly, produced minerals flow from the well 16 to the manifold via the wellhead assembly 12 and/or the tree 29 before being routed to shipping or storage facilities.

The tubing spool 28 provides a base for the tree 29. Typically, the tubing spool 28 is one of many components in a modular subsea or surface mineral extraction system 10 that is run from an offshore vessel or surface system. The tubing spool 28 includes a tubing spool bore 36. The tubing spool bore 36 sealably connects (e.g., enables fluid communication between) the tree bore 34 and the well 16. Thus, the tubing spool bore 36 may provide access to the well bore 20 for various completion and worker procedures. For example, components can be run down to the wellhead assembly 12 and disposed in the tubing spool bore 36 to seal-off the well bore 20, to inject chemicals down-hole, to suspend tools down-hole, to retrieve tools down-hole, and the like. As mentioned above, the tubing spool 28 may be coupled to the casing spool 24. The casing spool 24 may include a bore 33 that sealably connects to the tubing spool bore 36 and may provide for casing or other components to be suspended or inserted into the casing spool 24.

Figure 2:
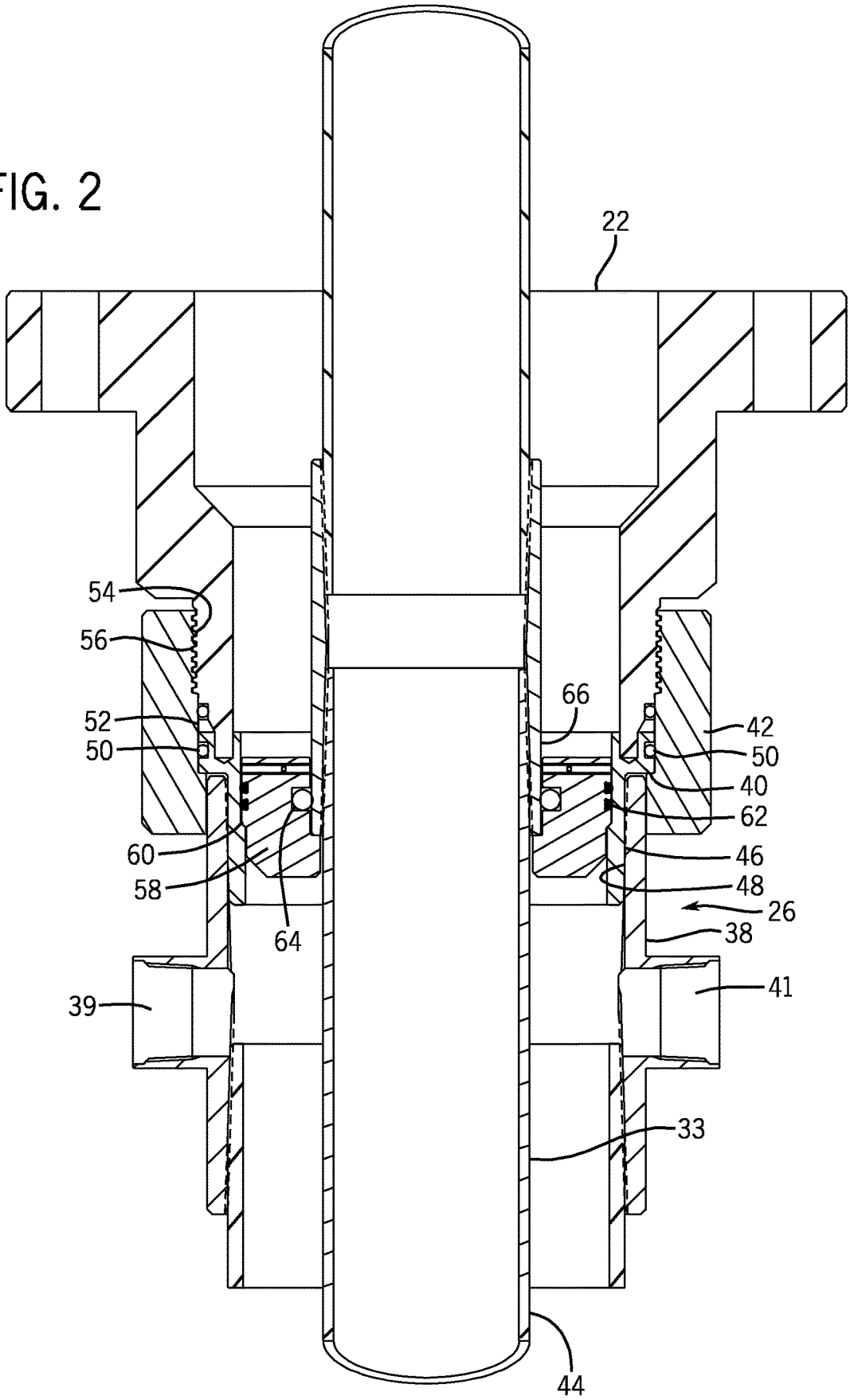
FIG. 2 is a cross-section of a BOP stack and multi-component tubular coupling in accordance with an embodiment of the present invention.

FIG. 2 is a cross-section of the BOP stack 22 and the multi-component tubular coupling 26 in accordance with an embodiment of the present invention. The multi-component tubular coupling 26 may include a first tubular member 38, a landing ring 40, and a second tubular member 42, e.g., a union nut. A casing string 44 may be installed in the casing spool 24 and extend though the coupling 26.

As shown in FIG. 2, the first tubular member 38, the landing ring 40, and the second tubular member 42 may be disposed concentrically around the bore 33 of the casing spool 24. As described in further detail below, the first tubular member 38, the landing ring 40, and the second tubular member 42 may be stacked axially to provide the assembled multi-component tubular coupling 26. The first tubular member 38 includes one or more inlets 39 and outlets 41. The landing ring 40 may include external threads 46 to couple to internal threads 48 of the first tubular member 38. The landing ring 40 may include annular seals 50 to seal against the second tubular member 42.

During installation, the BOP 22 may land on an upper portion 52 of the landing ring 40 of the coupling 26. The BOP 22 may be further secured to the second tubular member 42 via external threads 54. The external threads 54 may engage internal threads 56 of the second tubular member 42. The BOP 22 may be installed by rotating the second tubular member 42 into engagement with the lower portion of the BOP 22.

FIG. 2 also includes a seal ring assembly 58 to provide sealing of the lower portion of the wellbore below the BOP 22. The seal ring assembly 58 may land on an internal beveled protrusion 60 of the landing ring 40. The seal ring assembly 58 may include external annular seals 62 to seal the seal ring against the landing ring 40. The seal ring assembly 58 may also include one or more internal annular seals 64 to seal an internal coupling 66, e.g., threaded sleeve, of the seal assembly 58.

Figure 3:
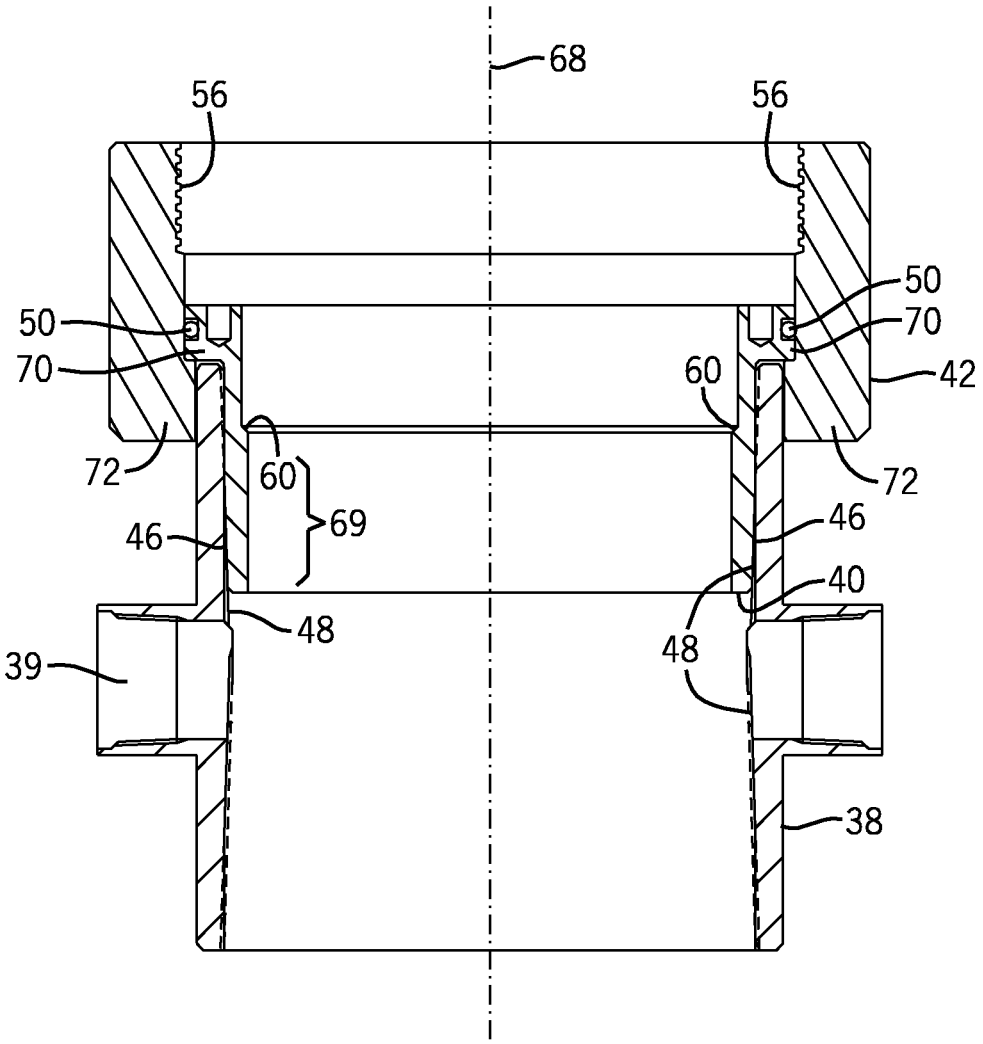
FIG. 3 depicts a cross-section of the multi-component tubular coupling in accordance with an embodiment of the present invention.
Figure 4:
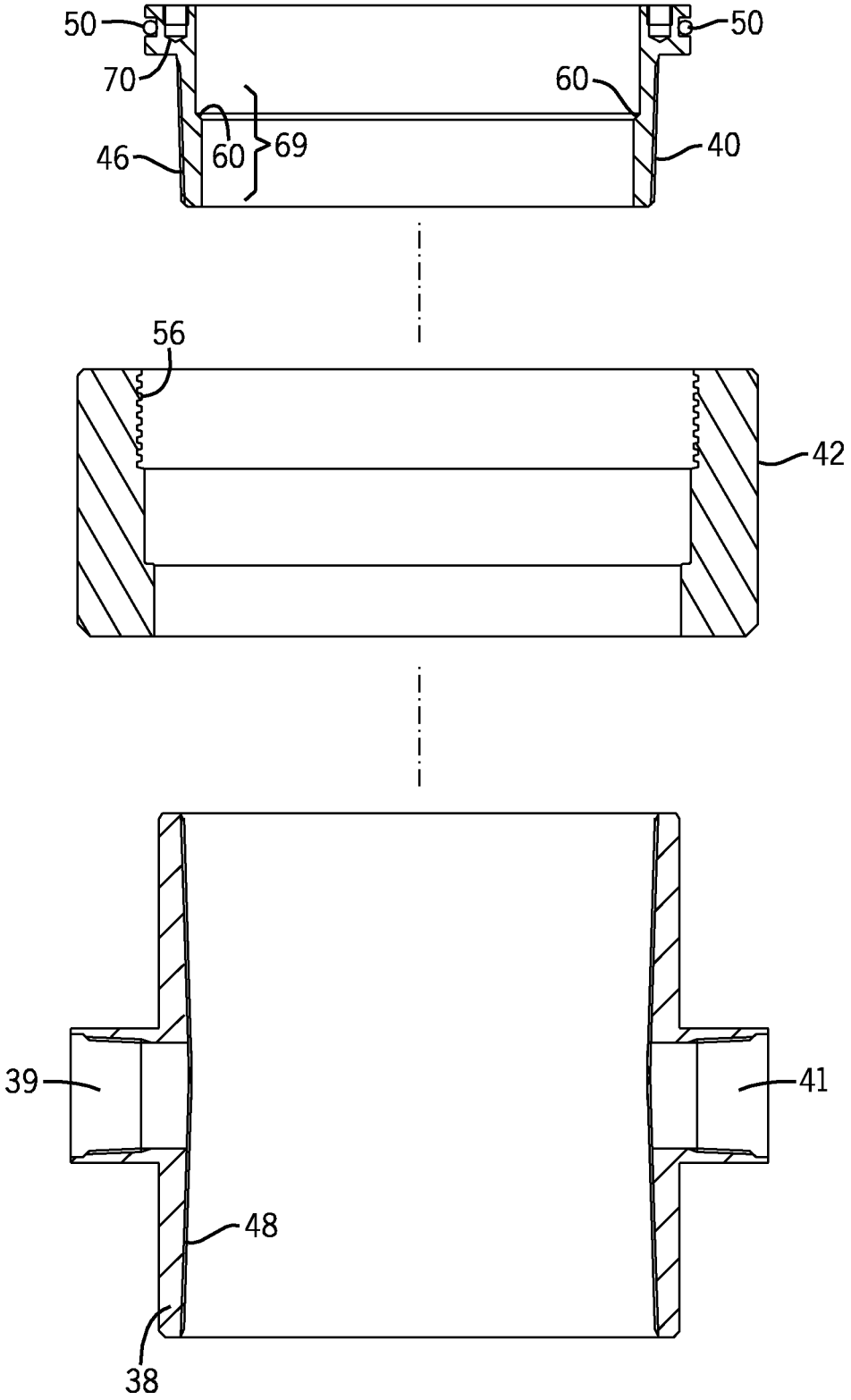
FIG. 4 depicts an exploded view of the multi-component tubular coupling in accordance with an embodiment of the present invention.

Turning now in greater detail to the multi-component tubular coupling 26, FIG. 3 depicts a cross-section of the multi-component tubular coupling 26 and FIG. 4 depicts an exploded view of the multi-component tubular coupling 26 in accordance with an embodiment of the present invention. As mentioned above, the multi-component tubular coupling 26 includes the first tubular member 38, the landing ring 40, and the second tubular member 42 arranged concentrically around a center axis 68, such as the center axis of the bore 33. In some embodiments, as described below, the second tubular member 42 may be omitted from the assembled multi-component tubular coupling 26.

As shown in FIG. 3, the landing ring 40 may be axially stacked onto the first tubular member 38 such that a portion 69 of the landing ring 40 extends axially into the interior of the first tubular member 38. The landing ring 40 may include an upper flanged portion 70 extending radially outward over the edge of the first tubular coupling 38. The landing ring 40 includes the internal beveled protrusion 60 to provide a landing point for various components coupled to the multi-component tubular coupling 26. As more clearly seen in FIG. 4, the landing ring 40 includes external threads 46 around the portion 69 of the landing ring 40 that extends axially into the interior of the first tubular member 38. The first tubular member 38 includes interior threads 48 configured to couple to the exterior threads 46 of the landing ring 40. In one embodiment, the interior threads 48 and exterior threads 46 may be API LCSG threads, such as Bakerlok® threads. Thus, the landing 40 may be coupled to the first tubular member 38 by engaging the exterior threads 46 of the landing ring 40 with the interior threads 48 of the first tubular member 38.

The second tubular member 42, e.g., a union nut, may include a annular protrusion 72 that extends radially inward underneath the upper flanged portion 70 to couple the second tubular member 42 to the landing ring 40 and, thus, to the first tubular member 38. As also mentioned above, the second tubular member 42 includes internal threads 56 to enable the second tubular member 42 to couple to a wellhead component coupled by the coupling 26.

The first tubular member 38 includes the inlet 39, the outlet 41, and internal threads 48. Advantageously, in some embodiments, the first tubular member 38 may be a standardized coupling having standardized internal and external diameters and/or standard threads. In such an embodiment, the inlet 39 and outlet 41 may be welded onto the first tubular member 38. Use of a standard coupling for the first tubular member 38 may reduce cost and increase availability of the multi-component tubular coupling 26. Additionally, elimination of any machining of the first tubular member 38 (by using the included threads on a standard coupling and welding the inlet 39 and outlet 41) also reduces cost and difficulty of manufacture. By using a standardized coupling for the first tubular member 38, the multi-component coupling may be more easily assembled (including easier assembly in the field) for a reduced cost as compared to non-standard specially designed and machined couplings.

Figure 5:
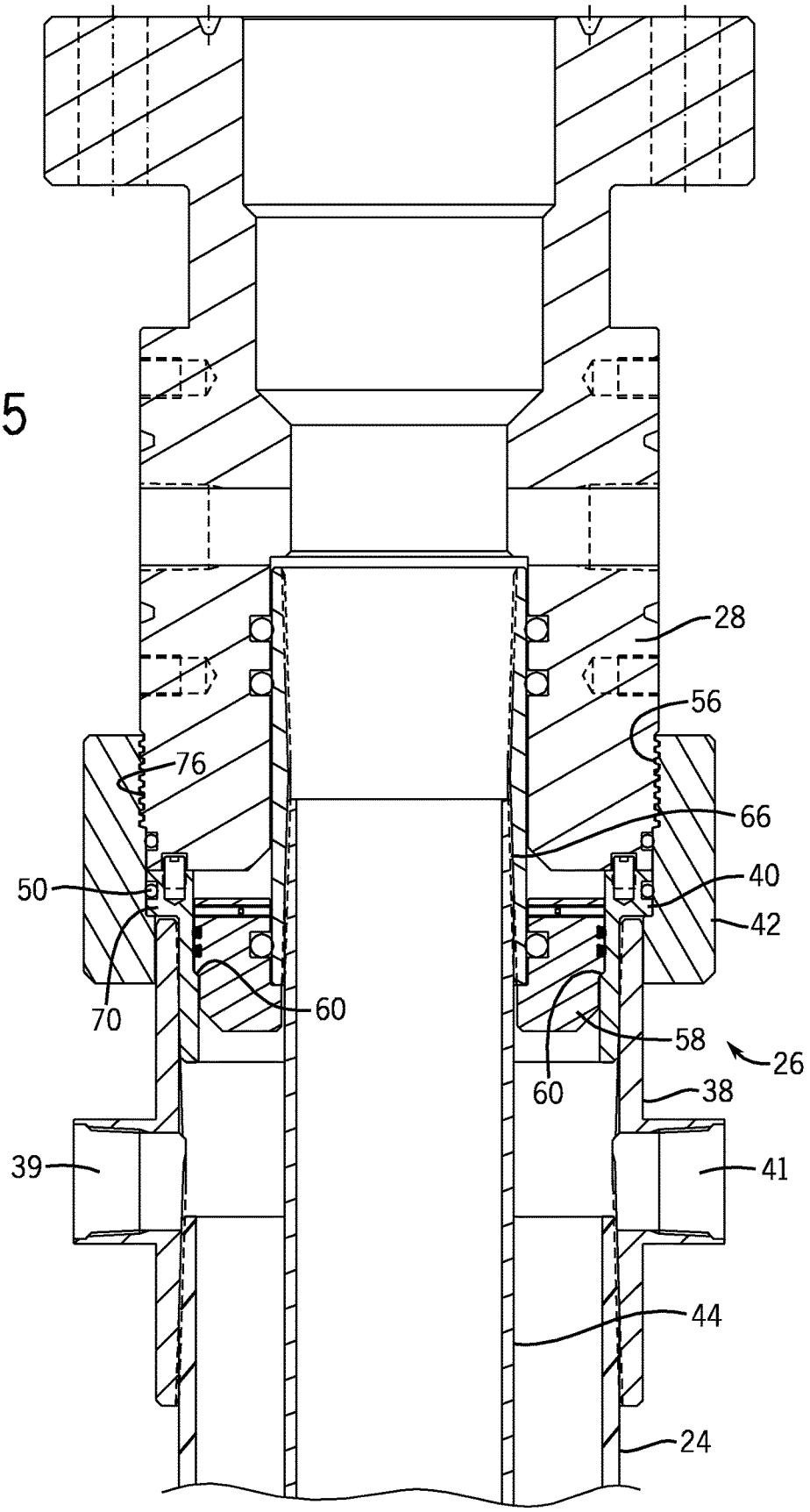
FIG. 5 is a partial cross-section of FIG. 1B depicting the tubing spool connected to the multi-component tubular coupling in accordance with an embodiment of the present invention.

FIG. 5 is a partial cross-section of FIG. 1B depicting the tubing spool 28 connected to the multi-component tubular coupling 26 in accordance with an embodiment of the present invention. As shown in FIG. 5, the tubing spool 28 may be installed by engaging the tubing spool 28 with the upper surface of the landing ring 40, such that the tubing spool 28 fits over the internal coupling 66 of the seal assembly 58. The tubing spool 28 may be further engaged with the wellhead assembly by the engagement of the internal threads 56 of the second tubular member 42 with external threads 76 of the tubing spool 28. As described above, the BOP 22 may be first removed from the multi-component tubular coupling 26 and then the tubing spool 28 may be installed on the multi-component tubular coupling 26 to couple the tubing spool 28 to the casing spool 24. In this manner, the BOP 22, tubing spool 28, and/or any other component may be interchangeably coupled to the casing spool 24 via the multi-component tubular coupling 26 without additional machining of the coupling 26 and/or the BOP 22, tubing spool 28, and/or other component. Additionally, the flanged portion 70 of the landing ring 40 is axially captured from below by the annular protrusion 72 and from above by the tubing spool 28 or other component.

Figure 6:
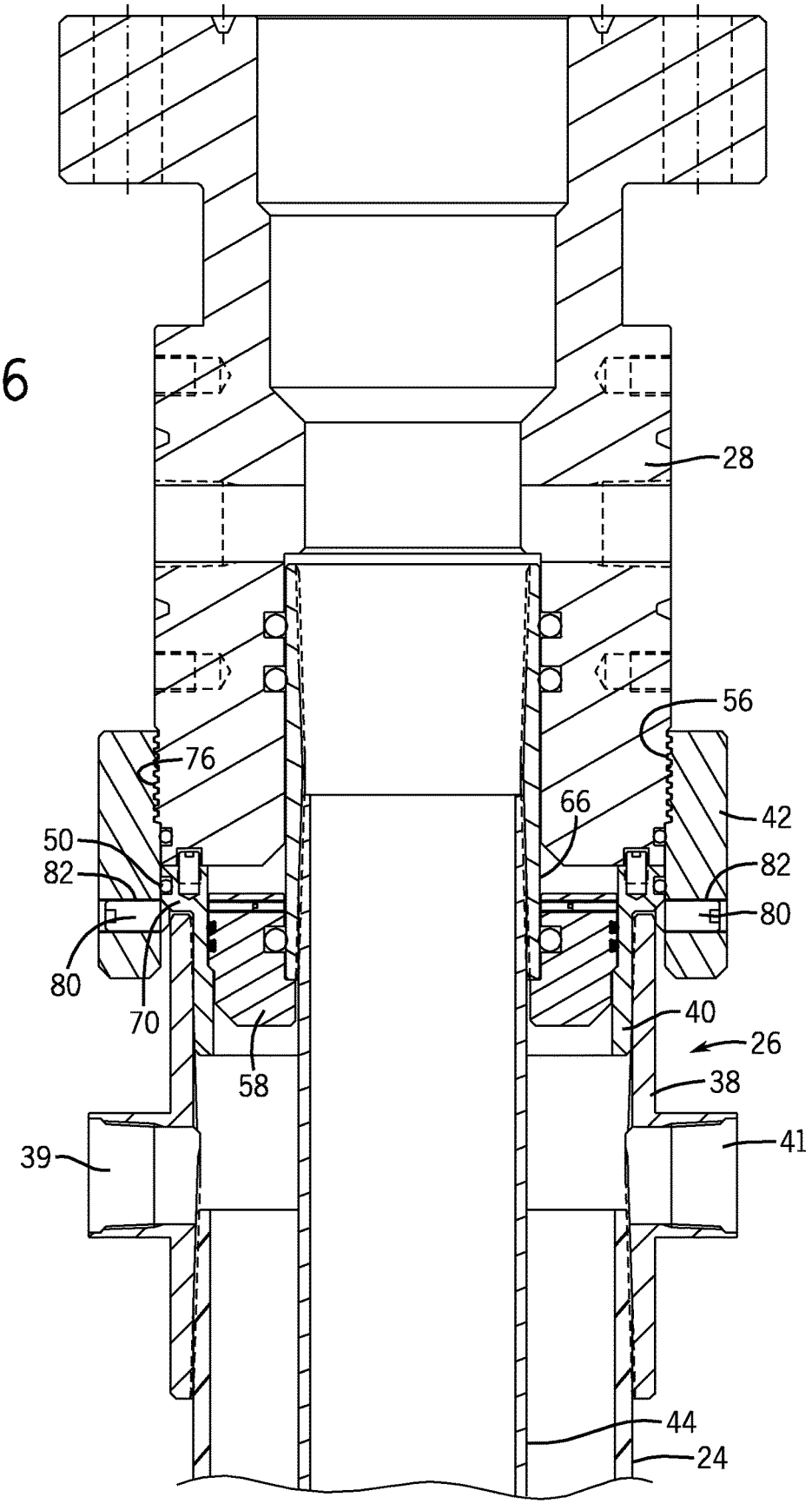
FIG. 6 is a cross-section of the multi-component tubular coupling having lock screws in combination with internal threads on a second tubular member in accordance with another embodiment of the present invention.

In some embodiments, the multi-component tubular coupling 26 may include lock screws for securing the second tubular member 42 of the coupling 26, either alone or in combination with the internal threads 56 of the second tubular member 42. FIG. 6 depicts an alternate embodiment of the multi-component tubular coupling 26 having lock screws 80 in combination with internal threads 56. As shown in FIG. 6, the lock screws 80 may insert radially in a receptacle 82 of the second tubular member 42. The lock screws 80 may insert through the second tubular member 42 to engage the flanged portion 70 of the landing ring 40. In such an embodiment, the second tubular member 42 may not include the annular protrusion 72, with the function of such protrusion 72 instead being replaced by the engagement of the lock screws 80 with the flanged portion 70 of the landing ring 40.

As described above, the tubing spool 28 is coupled to the second tubular member 42 via engagement of internal threads 56 with external threads 76 of the tubing spool 28. The addition of the lock screws 80 further secure the tubing spool 28 and the second tubular member 42 to the landing ring 40, preventing further axial translation and/or rotational movement of the tubing spool 28. Thus, the flanged portion 70 is axially captured between the lock screws 80 engaging the flanged portion 70 from below, and the threaded connection (e.g., threads 56 and 76) between the second tubular member 42 and the tubing spool 28 from above. It should be appreciated that lock screws 80 may be replaced by any suitable fastener, such as pins, tie down screws, etc.

Figure 7:
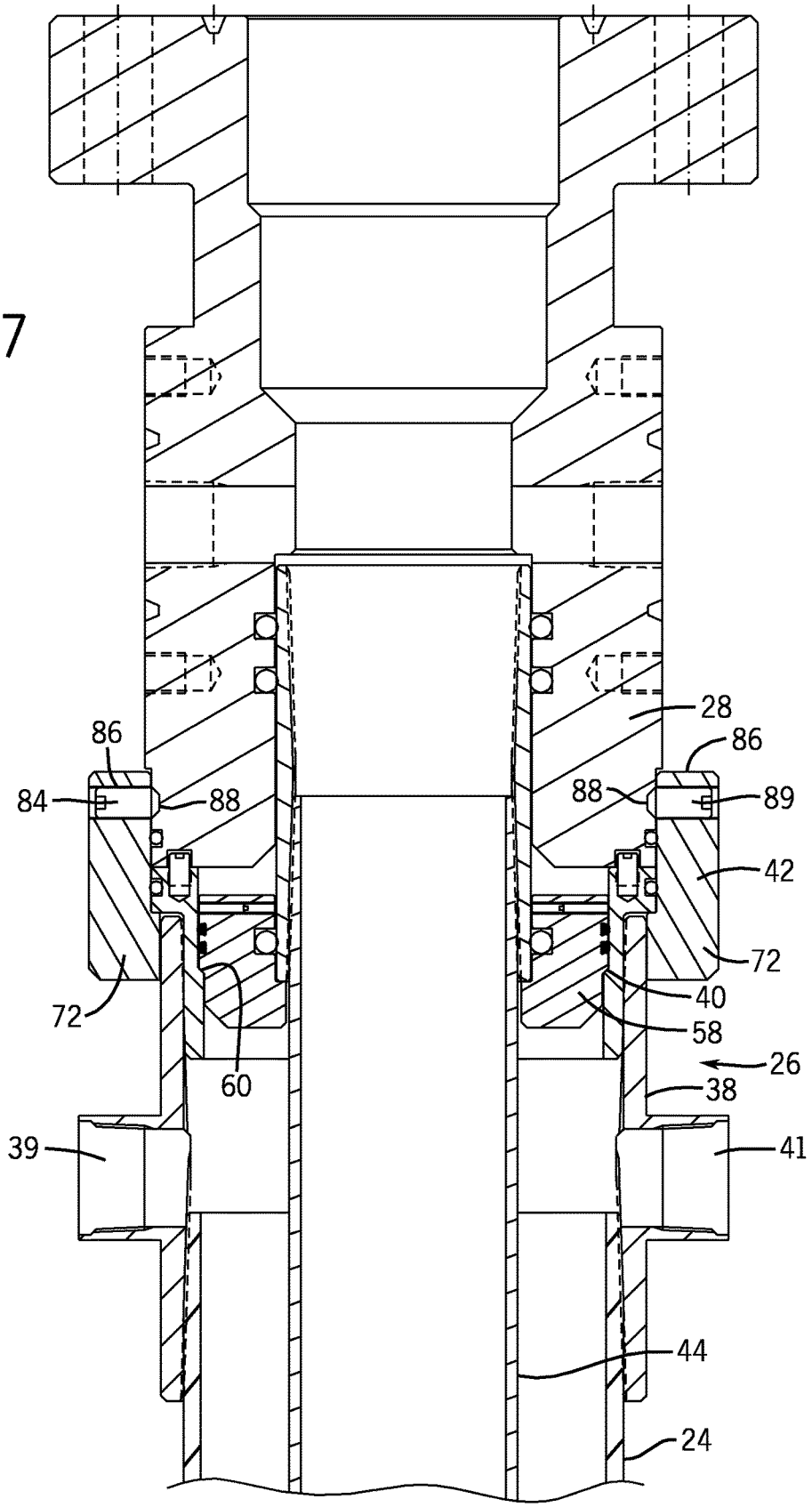
FIG. 7 is a cross-section of the multi-component tubular coupling having lock screws and without internal threads on the second tubular member in accordance with another embodiment of the present invention.

FIG. 7 depicts an alternate embodiment of the multi-component tubular coupling 26 having lock screws 84 and without internal threads 56 on the second tubular member 42. As shown in FIG. 7, one or more lock screws 84 may insert radially in one or more receptacles 86 of the second tubular member 42. The receptacle 86 is located at and may replace the internal threads 56 of the second tubular member 42. Instead of or in addition to external threads 76, the tubing spool 28 may include recesses 88 configured to receive the lock screws 84. Thus, to engage the multi-component tubular coupling 26 with the tubing spool 28, the lock screws 84 may be inserted radially through the receptacle 86 of the second tubular member 42 and into engagement with the recesses 88 of the tubing spool 28. In such embodiment, the second tubular member 42 may also include the annular protrusion 72 extending under the flanged portion 70 of the landing ring 40. The flanged portion 70 of the landing ring 40 is axially captured between the annular protrusion 72 of the second tubular member 42 and the tubing spool 28 or other component.

Figure 8:
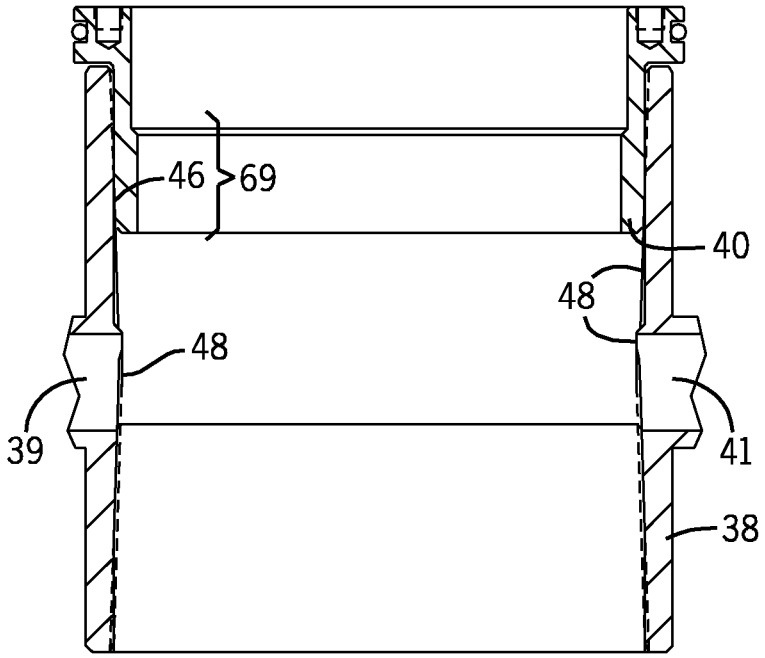
FIG. 8 is a cross-section of the multi-component tubular coupling without a second tubular member in accordance with another embodiment of the present invention.

In some embodiments, the multi-component tubular coupling 26 may only include the first tubular member 38 and the landing ring 40, without the second tubular member 42. FIG. 8 depicts an alternate embodiment of the multi-component tubular coupling 26 without the second tubular member 42. As shown in FIG. 8, this embodiment of the multi-component tubular coupling 26 only includes the first tubular member 38 and the landing ring 40. The first tubular member 38 maintains the inlet 39 and outlet 41, which may be welded to a standard coupling as described above. Similarly, the portion 69 the landing ring 40 is partially disposed inside the first tubular member 38 and maintains the upper flanged portion 70 extending radially outward over the wall of the first tubular member 38. The landing ring 40 includes external threads 46 to couple the landing ring to the internal threads 48 of the first tubular member 38.

Figure 9:
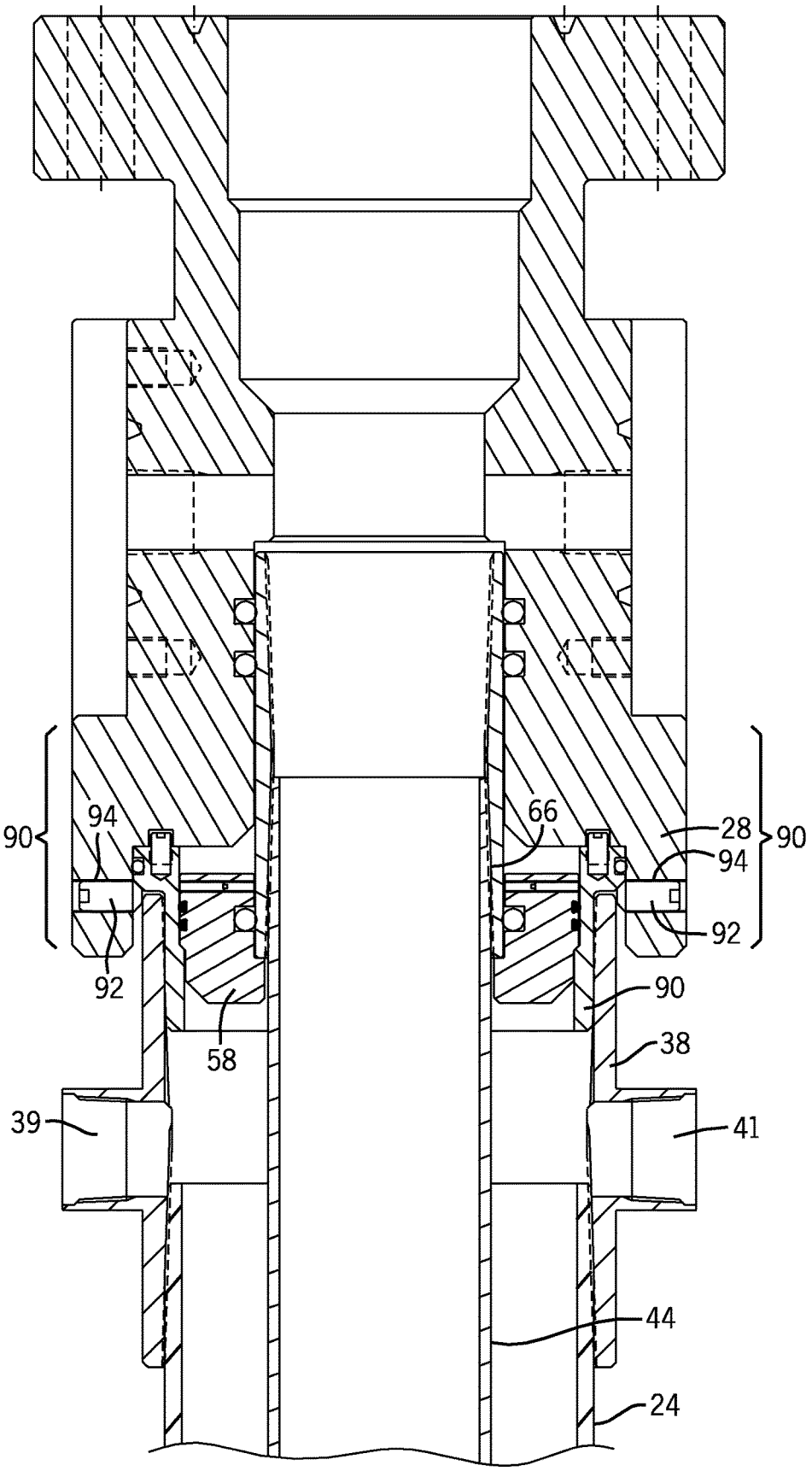
FIG. 9 is a cross-section of a tubing spool and the multi component tubular coupling without the second tubular member in accordance with another embodiment of the present invention

FIG. 9 depicts the multi component tubular coupling 26 of FIG. 8 without the second tubular member 42 in the wellhead assembly 12 in accordance with an alternate embodiment of the present invention. In such an embodiment, as shown in FIG. 9, the tubing spool 28 may include an axially extended annular portion 90 that extends over the landing ring 40. The extended annular portion 90 may include lock down screws 92 inserted into receptacles 94. The lock screws 92 may be inserted through the receptacles 94 and into engagement with a tapered surface 96 of the upper flanged portion 70 of the landing ring 40. In this embodiment, the tubular spool 28 may or may not include external threads; however, the lock screws 92 are used to couple the tubing spool 28 to the multi-component tubular coupling 26, preventing axial translation and/or rotational movement of the tubing spool 28. The multi-component tubular coupling 26 depicted in FIG. 9 does not include the second tubular member 42, as the lock down screws 92 provide the engagement between the tubing spool 28 and the coupling 26 and, thus, between the tubing spool 22 and the casing spool 24.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a coupling for a mineral extraction system, wherein the coupling comprises:

a landing ring comprising a landing portion and a first protruding portion extending radially relative to the landing portion;

a first tubular comprising a first tubular portion coupled to the landing ring; and a second tubular comprising a second tubular portion and a second protruding portion extending radially relative to the second tubular portion, wherein a first abutment surface of the first protruding portion is configured to radially overlap with a second abutment surface of the second protruding portion and a third abutment surface of the first tubular to block axial movement between the landing ring, the first tubular, and the second tubular.

2. The system of claim 1, comprising a seal ring landed on the landing portion of the landing ring, and an internal coupling disposed inside the seal ring.

3. The system of claim 2, comprising a string extending through the coupling, wherein the string is coupled to the internal coupling with threads.

4. The system of claim 1, wherein the landing ring extends axially into the first tubular.

5. The system of claim 1, wherein the landing ring is threaded to the first tubular.

6. The system of claim 1, wherein the first protruding portion comprises an annular flange having the first abutment surface.

7. The system of claim 6, wherein the annular flange is disposed at a first axial end of the landing ring, and the first abutment surface of the annular flange faces away from the first axial end toward an opposite second axial end of the landing ring.

8. The system of claim 6, wherein the annular flange extends radially over an axial end of the first tubular, and the landing ring extends axially into the first tubular.

9. The system of claim 6, wherein the second protruding portion comprises an annular protrusion.

10. The system of claim 6, wherein the second protruding portion comprises a lock screw extending in a radial direction.

11. The system of claim 1, wherein the second protruding portion is disposed at a first axial end portion of the second tubular and threads are disposed at an opposite second axial end portion of the second tubular.

12. The system of claim 1, wherein the third abutment surface is disposed radially between the first and second abutment surfaces.

13. The system of claim 1, comprising a wellhead component coupled to the coupling.

14. A system, comprising:

a wellhead component; and a coupling coupled to the wellhead component, wherein the coupling comprises:

a first tubular comprising a first tubular portion;

a second tubular comprising a second tubular portion; and a landing ring comprising a landing portion and a first protruding portion, wherein the landing portion is disposed inside the first tubular portion, the first protruding portion extends radially across an axial end of the first tubular portion, and the second tubular portion extends at least partially about the first tubular portion and the landing ring.

15. The system of claim 14, wherein the second tubular comprises a second protruding portion, and the first and second protruding portions are configured to radially overlap to block axial movement therebetween.

16. The system of claim 14, comprising a seal ring landed on the landing portion of the landing ring, and an internal coupling disposed inside the seal ring.

17. The system of claim 14, wherein the landing ring extends axially into the first tubular and couples to an interior of the first tubular.

18. The system of claim 17, wherein the landing ring is threaded to the interior of the first tubular.

19. The system of claim 14, wherein the second protruding portion comprises an annular protrusion or a radial lock screw.

20. A system, comprising:

a coupling for a mineral extraction system, wherein the coupling comprises:

a landing ring comprising a landing portion and a first protruding portion extending radially relative to a central axis of the coupling;

a seal ring landed on the landing portion of the landing ring; and an internal coupling disposed inside the seal ring, wherein the internal coupling comprises a first coupling portion configured to couple with a tubing extending below the landing ring, the seal ring, and the internal coupling.

21. The system of claim 20, wherein the coupling comprises a first tubular comprising a first tubular portion coupled to the landing ring, and a second tubular comprising a second tubular portion and a second protruding portion extending radially relative to the central axis of the coupling, wherein a first abutment surface of the first protruding portion is configured to radially overlap with a second abutment surface of the second protruding portion and a third abutment surface of the first tubular to block axial movement between the landing ring, the first tubular, and the second tubular.

22. The system of claim 20, wherein the internal coupling comprises a second coupling portion configured to couple with a component above the landing ring, the seal ring, and the internal coupling.

* * * * *